US008672196B2

(12) United States Patent
Pourian et al.

(10) Patent No.: US 8,672,196 B2
(45) Date of Patent: Mar. 18, 2014

(54) DISPENSABLE PRODUCT CONTAINER

(75) Inventors: Neema Pourian, Chicago, IL (US); Adam Hunter, Park Ridge, IL (US); Wenson R. Chern, Mountain View, CA (US); Robert D. Swinton, San Francisco, CA (US)

(73) Assignee: Wm. Wrigley Jr. Company, Chicago, IL (US)

( * ) Notice: Subject to any disclaimer, the term of this patent is extended or adjusted under 35 U.S.C. 154(b) by 1 day.

(21) Appl. No.: 13/254,773

(22) PCT Filed: Feb. 26, 2010

(86) PCT No.: PCT/US2010/025498

§ 371 (c)(1),
(2), (4) Date: Nov. 1, 2011

(87) PCT Pub. No.: WO2010/101773

PCT Pub. Date: Sep. 10, 2010

(65) Prior Publication Data

US 2012/0160881 A1 Jun. 28, 2012

Related U.S. Application Data

(60) Provisional application No. 61/156,693, filed on Mar. 2, 2009.

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 47/00*** | (2006.01) |
| ***B65D 43/26*** | (2006.01) |
| ***B65D 43/20*** | (2006.01) |

(52) U.S. Cl.
USPC ..... 222/498; 220/263; 220/350; 222/556

(58) Field of Classification Search
USPC ..... 220/498, 502, 556, 4.21, 4.22, 213, 220/250, 263, 345.1, 350, 836, 837, 845; 215/260, 270; 222/498, 502, 556, 481, 222/484
See application file for complete search history.

(56) References Cited

U.S. PATENT DOCUMENTS

| | | | | |
|---|---|---|---|---|
| 3,094,244 | A * | 6/1963 | White | 222/23 |
| 3,251,509 | A * | 5/1966 | Foster | 222/153.07 |
| 3,853,251 | A | 12/1974 | Alpern | |
| 4,095,712 | A * | 6/1978 | Perrella | 220/254.5 |

(Continued)

OTHER PUBLICATIONS

International Search Report for PCT/US2010/025498 dated May 28, 2010.

*Primary Examiner* — Paul R Durand
*Assistant Examiner* — Vishal Pancholi
(74) *Attorney, Agent, or Firm* — Armstrong Teasdale LLP

(57) ABSTRACT

A container (10) suitable for dispensing comestible products has a body (12) with a top face segment (36) having an opening (14) and a concave top face segment (18) and a separate continuous member (40) connected to a side face (24), the member having an openable lid portion (42) which covers the opening and a flexible press portion (50) extending from the lid portion to the side face over the concave top segment face, which is normally convex to the concave top face segment, wherein application of a downward force to the convex flexible press portion transforms the convex portion to a concave portion and rotates the lid portion to uncover the opening.

16 Claims, 10 Drawing Sheets

(56) References Cited

U.S. PATENT DOCUMENTS

| | | | | | |
|---|---|---|---|---|---|
| 4,607,768 | A | * | 8/1986 | Taber et al. | 222/556 |
| 4,615,462 | A | * | 10/1986 | Sacherer et al. | 16/227 |
| 4,782,985 | A | * | 11/1988 | Kinsley | 222/481.5 |
| 4,901,892 | A | * | 2/1990 | Song | 222/498 |
| 5,273,177 | A | | 12/1993 | Campbell | |
| 5,718,347 | A | * | 2/1998 | Walker et al. | 215/209 |
| 5,735,438 | A | | 4/1998 | Ostrowsky | |
| 6,257,452 | B1 | | 7/2001 | Allen | |
| 6,460,729 | B2 | * | 10/2002 | Beecroft | 222/1 |
| 6,471,083 | B1 | * | 10/2002 | Helms | 220/259.1 |
| 6,561,391 | B1 | * | 5/2003 | Baker | 222/556 |
| 6,732,873 | B2 | * | 5/2004 | Bried et al. | 215/235 |
| 2003/0159965 | A1 | | 8/2003 | Baker | |

* cited by examiner

DISPENSABLE PRODUCT CONTAINER

BACKGROUND OF THE INVENTION

This invention relates to packaging and more particularly relates to containers for storing and dispensing products such as comestibles.

Consumers desire product packages or containers from which product pieces are easily dispensed. Especially, consumers desire dispensable product containers which may be manipulated with one hand to open the container for product removal. Further, a desirable container does not open accidently to spill product contents.

An additional desirous feature of a consumer package is an ability to fill the package or container easily with commercial manufacturing equipment and processes.

SUMMARY OF THE INVENTION

A container suitable for dispensing comestible products has a body with a top face segment having an opening and a concave top face segment and a separate continuous member connected to a side face, the member having an openable lid portion which covers the opening and a flexible press portion extending from the lid portion to the side face over the concave top segment face, which is normally convex to the concave top face segment, wherein application of a downward force to the convex flexible press portion transforms the convex portion to a concave portion and rotates the lid portion to uncover the opening.

DESCRIPTION OF THE INVENTION

Figure 1:
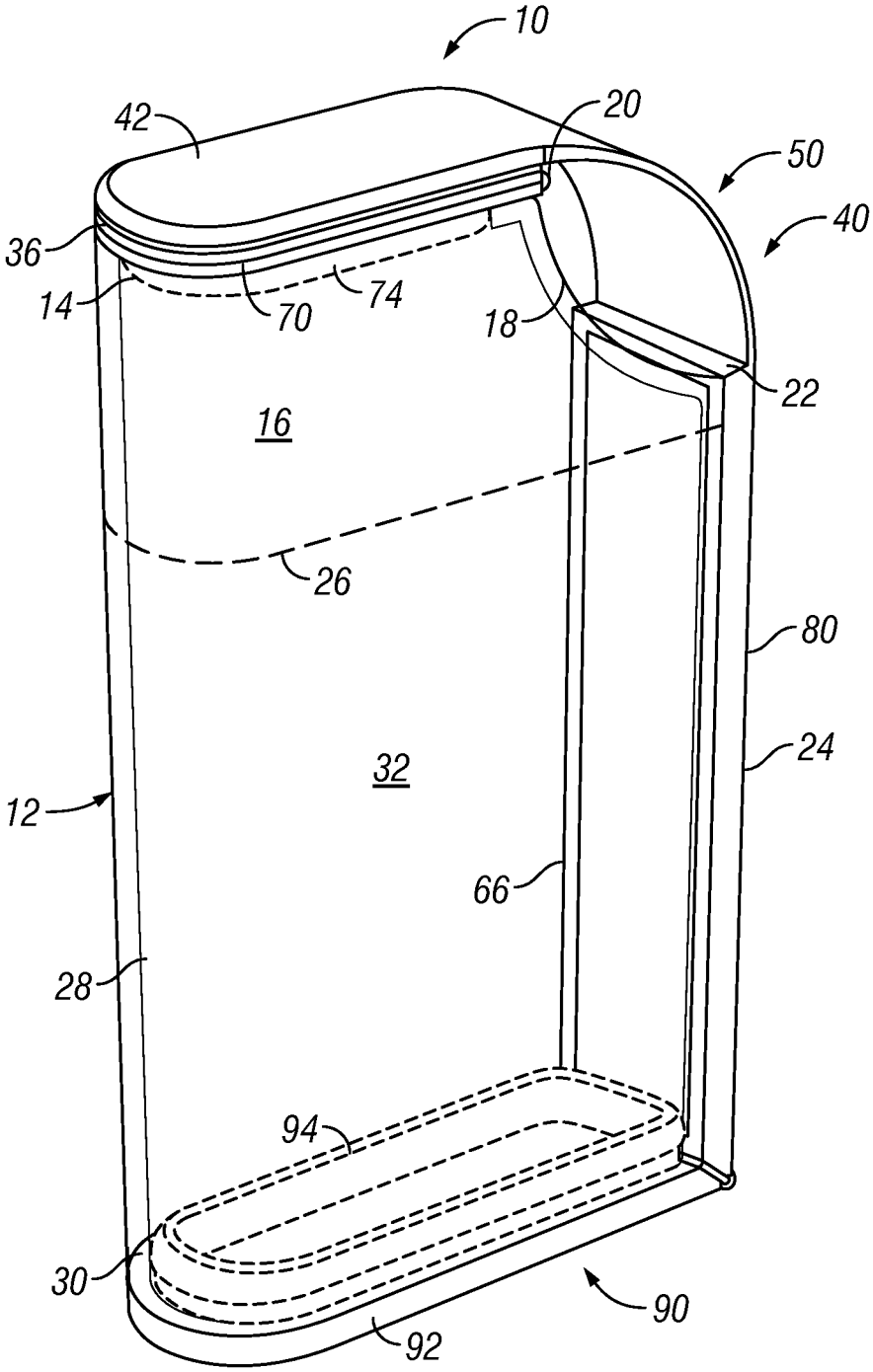
FIG. 1 is a perspective view of a dispensable product container of the present invention.

This invention is directed to a container from which separate product pieces such as comestible products may be dispensed. Such container has a body portion typically constructed of a material such as a plastic, which has sufficient stiffness to retain a shape upon application of typical hand force at room temperature. A body portion has a top, a bottom face, a front face, a back face and at least one side face. The top has at least two face segments in which one such face segment has an opening to the interior of the container and a second top face segment which is attached to the first top face segment and is sloped toward, and is concave to, the bottom face. The first top face segment, which contains the opening, may be angled with respect to the bottom face such as up to 5, up to 10, up to 20 or more degrees for ease of dispensing product or may be parallel to the bottom face. "Parallel" means that plane of the first top face segment and the plane of the bottom face are parallel to an ordinary observer, such as may be constructed using typical manufacturing techniques. Plastic material suitable for a body includes polyethylene, polypropylene, polyolefin copolymers, polystyrene, polyester, polycarbonate, and the like.

In an aspect of the invention, a separate continuous flexible member is connected to a side face such that a portion of such flexible member wraps over the top face and has a lid portion which covers the container opening and a flexible press portion which extends from the lid portion to the side face and normally forms a convex portion over the concave top face segment. Typically, the flexible member is connected to top face at the junction of the first top face segment (containing the opening) and the second concave top face segment. Such connection typically provides an axis of rotation around which the lid portion may rotate from a closed position to an open position.

A suitable flexible member useful in this invention is constructed from a flexible material such as a flexible plastic. Although flexible, a suitable material typically has sufficient stiffness such that the flexible press portion retains shape and when the press portion is pressed, sufficient force is applied to rotate the lid portion. An example of such a material is a polyolefin thermoplastic elastomer. Alternatively, suitably flexible grades of other polymers such as polypropylene, high density polyethylene, low density polyethylene, and olefin copolymers such as ethylene-propylene copolymers may be used. Typically, a suitable material provides enough opening force to overcome the snap fit of the lid and is sufficiently flexible to deform upon application of hand force. Preferably, the flexible member is molded as a single continuous piece and incorporates a side portion, a press portion, a lid portion, and optionally an opening insert portion and a bottom portion. The flexible member is separate in a sense that the member is constructed from a different material or different grade of a material than the body and is connected to the body. The container body and flexible member may be the same or different color. The flexible member may provide a grip area on the top or bottom to facilitate handling of the container as well as stacking upon a display.

The flexible member includes a lid designed to cover the top opening of the top face segment in the body. The lid may fit into the opening with an insert, which typically extends downward from the lid into the opening and may only include one or more sides to engage the opening. The lid also may have a catch which engages an indent portion of the insert. The catch functions such that when the lid is pressed into the opening, the catch bends slightly inward and then falls into stationery engagement with the indent portion. Typically, the lid is resistant to accidental opening.

The press portion also may include a reinforced band or ribs to provide the press portion with additional rigidity and provide for additional material flow during forming of the flexible member. The press portion may include ridges or text such as "press here" to indicate to the user where to engage the press portion. In operation the press portion normally moves from a convex position to a concave position.

In a further aspect of this invention, the flexible member may be connected by suitable means such as mechanically or adhesively to a side face. Alternatively, the flexible member attached to the body may be produced by overmolding a flexible polymer onto the body. In another aspect the flexible member may incorporate an insert portion hinged to the flexible member and adapted to fit within the top face body opening. In such aspect, the lid portion is adapted to engage the insert and to close and open within the insert portion.

The side face to which the flexible member is attached typically is flat to promote a firm adhesive or mechanical connection. The opposing side of the container body may be curved, which forms a curved spout structure at the container opening. In another aspect, the opposing face is flat. The container body may include variations wherein the spout structure is independent of, and detachable from, the body.

In operation, a consumer applies a downward force to the convex flexible press portion to conform the flexible press portion to the concave top face segment, which thereby acts to rotate the lid portion such that the opening is uncovered. After such action, product pieces in the container may be removed by the consumer. The lid portion may be closed manually by the consumer by pressing the lid back into the opening. Typically, a consumer is able to open the container lid in a one-handed operation in which a consumer's thumb applies force to the press portion.

In another aspect of this invention, the bottom face may contain an opening which may be covered by an extension of the flexible member portion or may be covered by a separate removable cover. The purpose of this bottom opening is to provide access to the container for filling product pieces. In this aspect, the bottom opening cover, whether a separate portion or an extension of the flexible member may be mechanically or adhesively sealed after filling. A preferred aspect includes a bottom portion which is part of the continuous flexible member connected to the side face. A larger open bottom facilitates container filling in contrast to filling through a relatively small top opening. Additionally, an open bottom may permit a secondary means of dispensing product if a user desires to remove multiple pieces of product. Alternatively, after an open bottom may be used to fill container, a bottom cover is fused shut and not openable by a user. An overwrap such as shrink wrap may enclose the container and provide tamper evidence.

In an alternate embodiment, an opening larger than the top opening may be provided in the side face of the body. In such an embodiment, the opening then could be covered the flexible member. Still alternatively, an opening larger than the top opening may be provided in front and back faces and may be covered by a label.

A suitable flexible member also may have a hinged bottom portion as part of the flexible member. The bottom portion may have an insert outer edge which conforms to the bottom of the body and a gasket insert which conforms to a lower channel of the container. The bottom portion may be designed to cover an open bottom of the body or it may be added as a decorative or functional portion to a closed bottom. The bottom portion also may be fastened with a means to remove the bottom piece from the bottom body. Alternatively, the bottom portion may be a separate fused piece or be a preformed part of the body.

The container body may be molded in two steps and then have the flexible member joined to the body. Typically, the flexible member is connected firmly to the side face of the body, especially at the top edge of the side face from which the press portion extends. Also, the press portion of the flexible member is attached firmly at the edge of the top face segment. These firm connections permit the press portion to direct force from deformation of the press portion to open the lid. If the flexible member is not connected securely to the body at the points which form the press portion, the ability to open the lid is compromised.

The connection between the press portion and the top face segment which incorporates the opening is adapted to form an axis of rotation around which the flexible member containing the lid may rotate upon application of force to the press portion. Such an axis may be along the edge line of the top face portion. In another embodiment, the connection between the press portion and the body at the top face may be a protrusion connected to or a part of the flexible member which mechanically fits or snaps into a suitably sized receptacle formed within the body at the top face. This connection provides a rotation axis around which the lid portion may open upon applying force to the press portion.

The dispensable product container may be hooked through the press portion with clips, hooks, carabineers and the like. Also the flexible portion may be fully pulled away from the top opening to permit the press portion to be positioned around a ring, belt loop and the like. Other embodiments of the dispensable product container may use a rigid press portion as a loop and instead open through a rigid-snap lid. These are but a few of the variations within the scope of this invention.

In a typical container of this invention a side face of the body may be curved. A spout and the top opening may follow or incorporate this curve. Additionally, the bottom face of the body also may follow or incorporate the shape of a curved side face and the generally rectangular front and back faces. The front and back faces of the container body may be flat and accommodate graphics describing the contents of the container. However, the shape of the container body may vary and include flat, curved, or polygonal faces.

In an aspect of this invention, the container is sized and shaped to be conveniently fit into a user's hand or pocket. The container is scalable to a variety of sizes, which may include up to fifteen, twenty-five, forty, sixty, or greater number of product pieces.

This invention provides a container suitable contain and dispense individual product pieces such as comestible products such as a chewing gum. Such product pieces may be of any shape or size compatible to the container. Examples of suitable shapes include tablet, pill, chunk, flat stick, pillow, round, rectangular, triangular, and combination thereof. A typical example of suitable comestible product pieces includes chewing gum pellets and other confectionary or food products. Additional dispensable product pieces include pharmaceutical products.

Embodiments of the container of this invention are illustrated in the Figures.

FIG. 1 illustrates a container 10 having a body 12 and a continuous flexible member 40. The body includes an opening 14 within a first top face segment 36 and a downwardly-sloping concave top face segment 18 and a side face 24 to which is adhesively connected the flexible member 40. The body has a front face 32 and opposing back face 66. The flexible member has a side portion 80, a press portion 50 and a lid portion 42. The body includes a bottom face with opening 30 which is covered by a bottom portion 90 of the flexible member. The bottom portion 90 has an insert outer edge 92 which conforms to the bottom opening 30 of the body 12 and a gasket insert 94 which conforms to a lower channel of the body. The upper dispenser portion 16 contains the body opening 14, a body top face segment containing opening 14, a concave top face segment 18, the lid 42 and the press portion 40. The integral spout 16 generally includes a portion of the receptacle 12 extending perpendicular from the curved concave portion bottom 22 indicated by the dashed line 26 which extends to the front of the container 28 which forms a side face opposing the side face 24. The press portion 50 is connected to the body at the top face segment at 20 and the side face at 22. The flexible member includes an insert 70 and contains a gasket insert 74 which fits within body opening 14.

Figure 2:
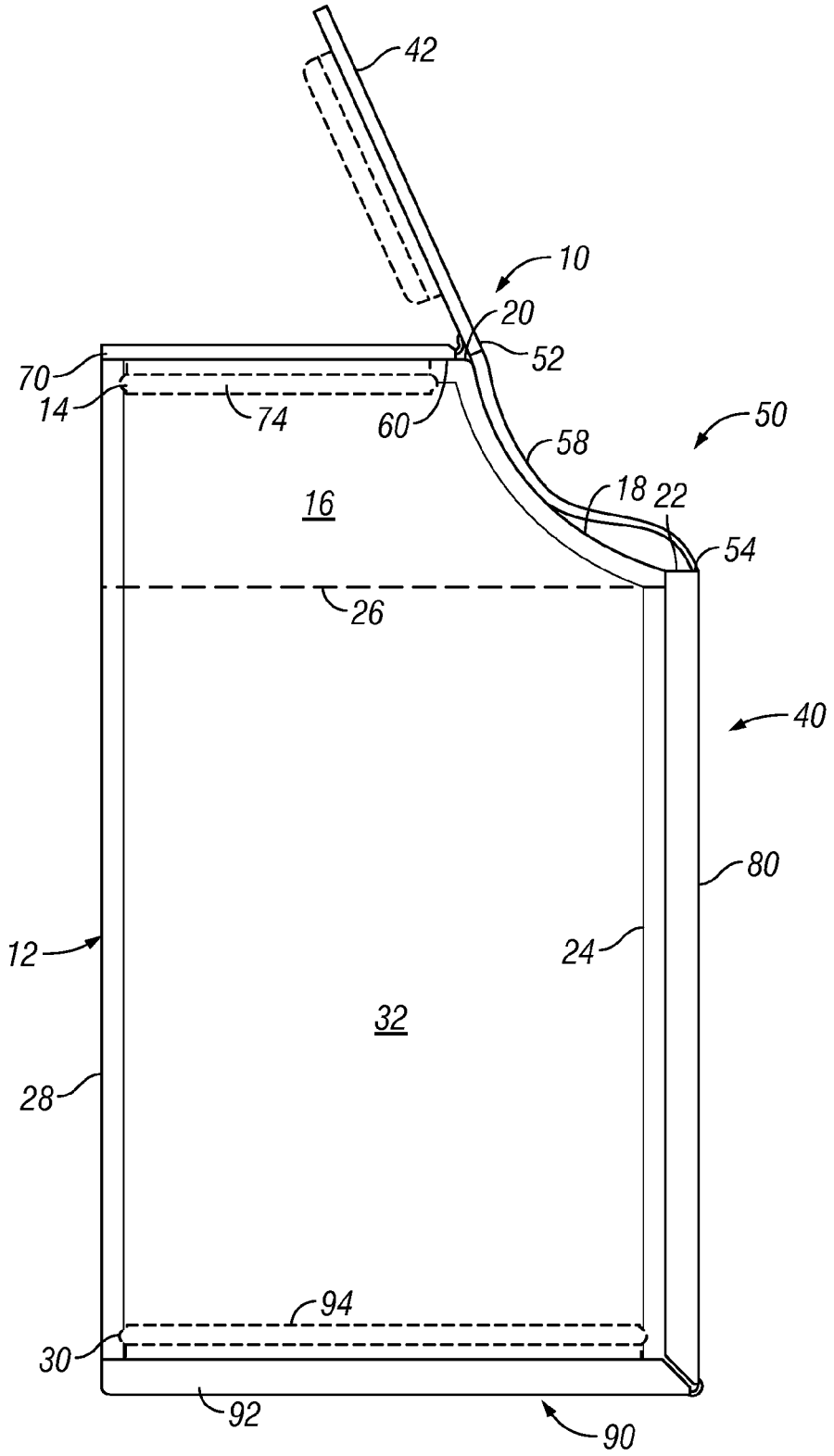
FIG. 2 is a side view of a dispensable product container with the press portion depressed and the lid in an open position.

FIG. 2 further illustrates a side view of the container shown in FIG. 1 and illustrates a configuration of the container upon pressing the press portion 50 to conform to the concave top face segment 18. In this view, flexible member 40 incorporates a press portion 50, which has an upper region 52 adjacent to and attached to the upper region 20 of the concave top face 18, a middle region 58 to which force is applied to open the lid 42, and a lower region 54 attached to side face 40 at 22.

Figure 3:
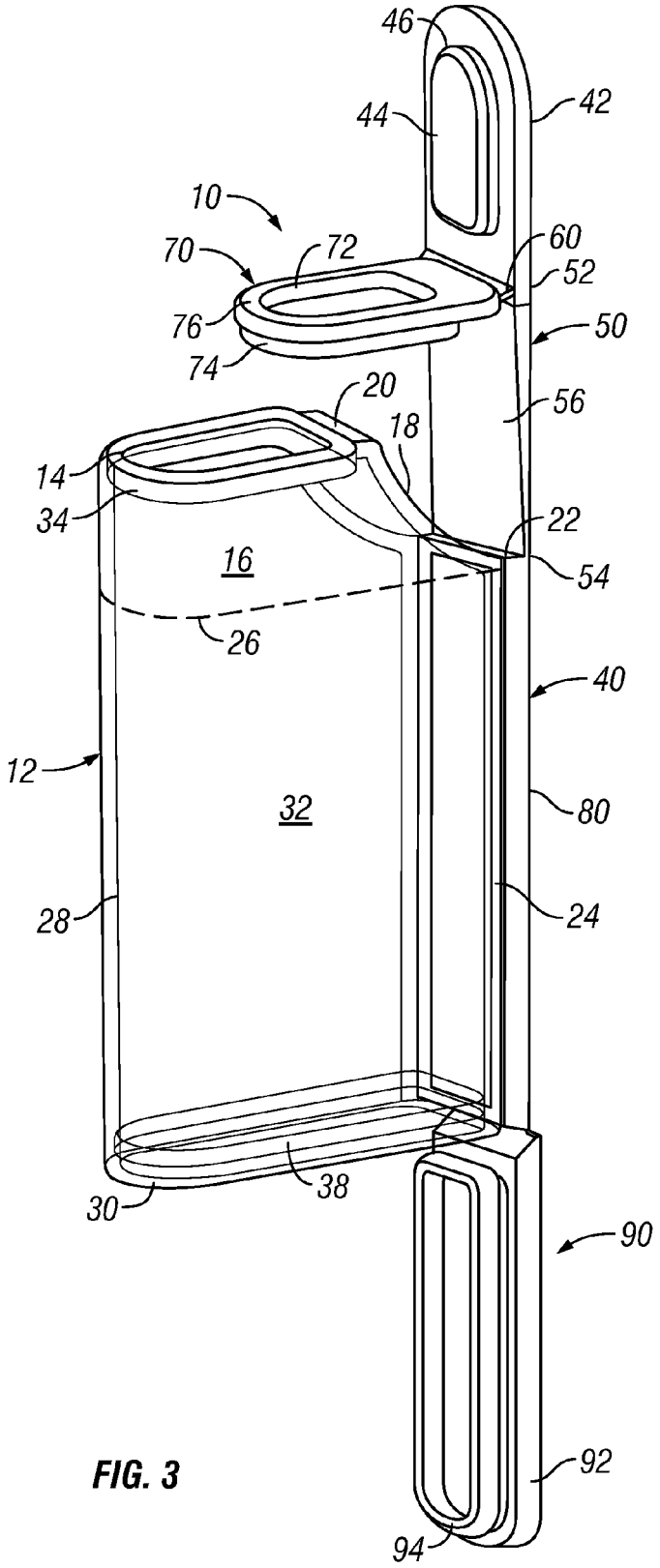
FIG. 3 is a perspective view of a dispensable product container with a flexible member removed from a top and bottom of the container.

FIG. 3 further illustrates the container shown in FIGS. 1 and 2 and shows a view in which the flexible member is not attached to the top or bottom faces. This view illustrates the insert 70 and bottom portion 90 as integral parts of flexible member 40. This view shows gasket insert 94 which conforms to a lower channel 38 of bottom face opening 30. Insert 70 is attached to flexible member 40 at hinge 60 and has an outer edge 72 corresponding to the top opening 14 of body 12 and a gasket insert 74 which fits within an upper channel 34 of body 12. Insert 70 may have an indent portion 76 to receive catch 46 of lid insert 44. Catch 46 is adapted to engage indent 76.

Figure 4:
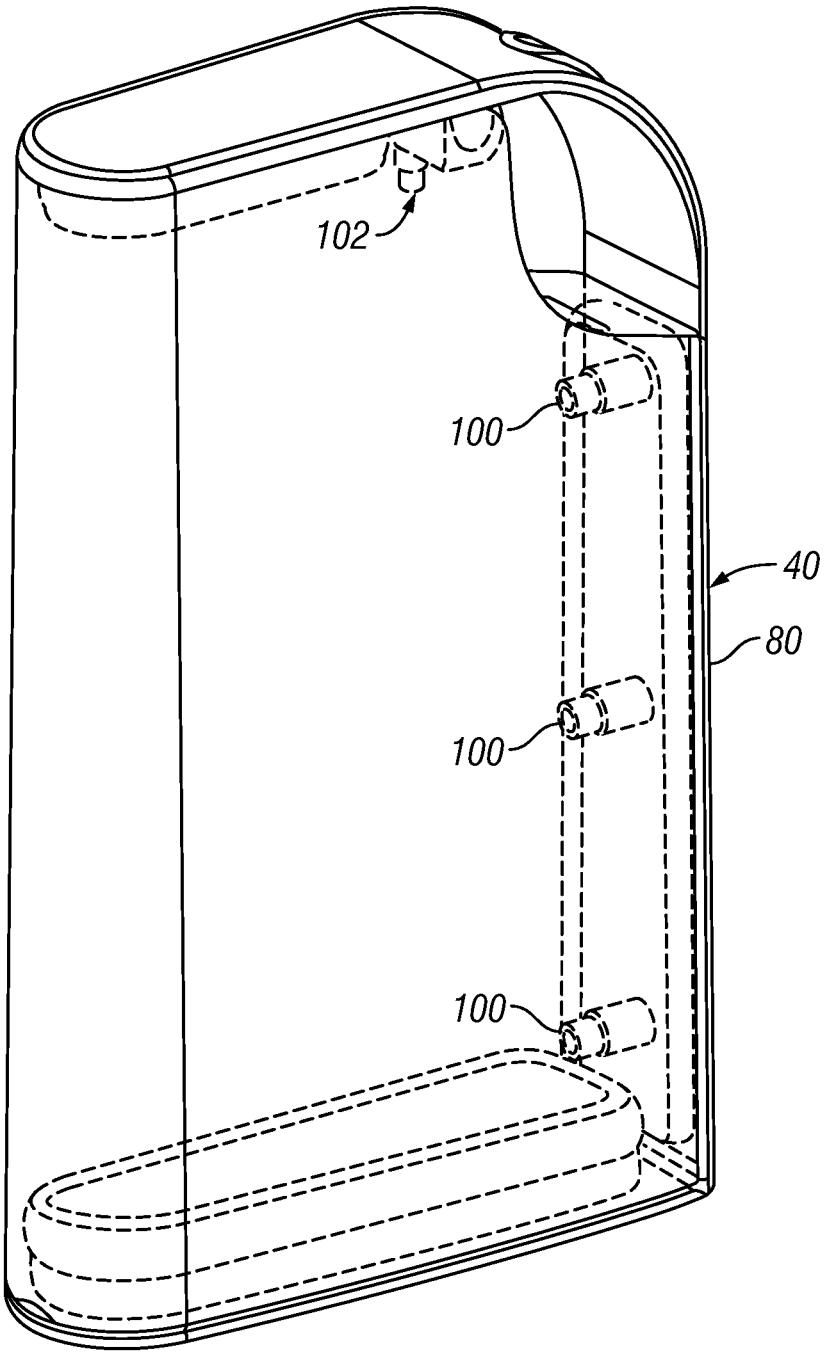
FIG. 4 is a perspective view of a dispensable product container with the flexible member attached to the side with mechanical tabs.

FIG. 4 illustrates a container in which the flexible member is attached to the body side face with mechanical tabs 100 adapted to fit within tab receptacles 104 in the body side face and to the top face with tab 102 adapted to fit into body receptacle 106.

Figure 5:
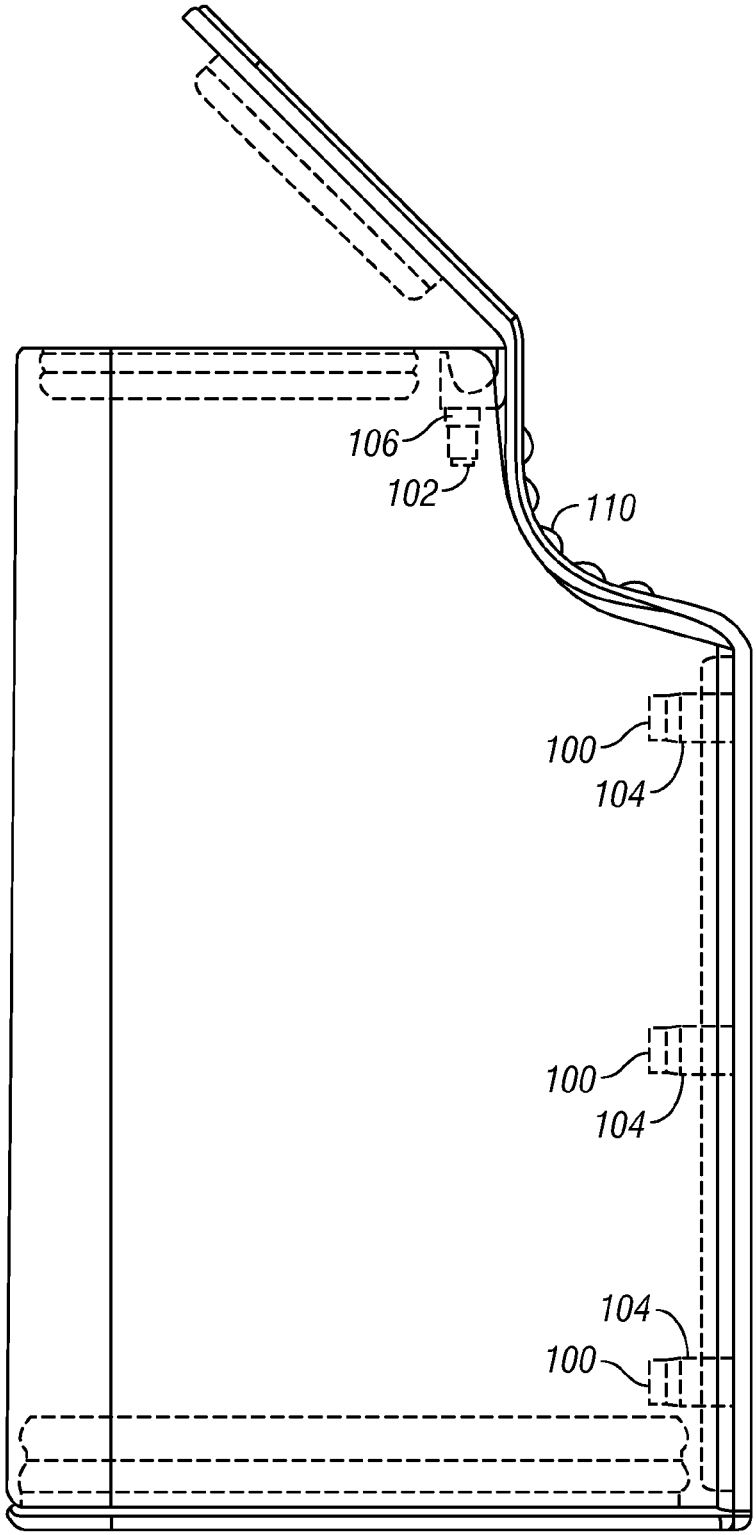
FIG. 5 is a side view of a dispensable product container with the flexible member attached to the side with mechanical tabs in an open position and with reinforcing ribs on the press portion.

FIG. 5 further illustrates the container shown in FIG. 4 with additional reinforcing ribs 110 on the press portion.

Figure 6:
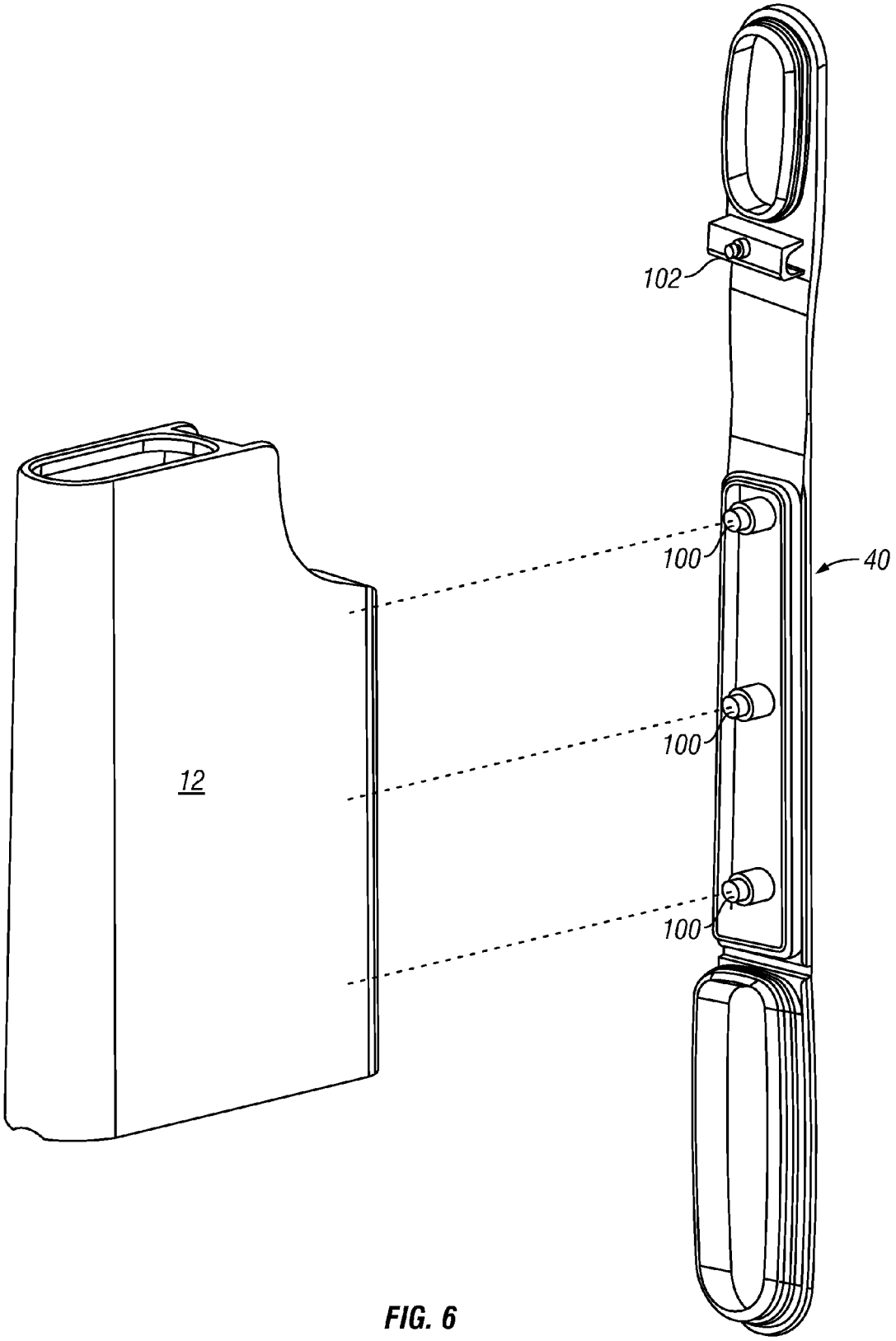
FIG. 6 is a view of a dispensable product container body and separate flexible member with mechanical tab attachments.

FIG. 6 illustrates the container shown in FIG. 4 with the flexible member 40 fully separated from the body 12.

Figure 7:
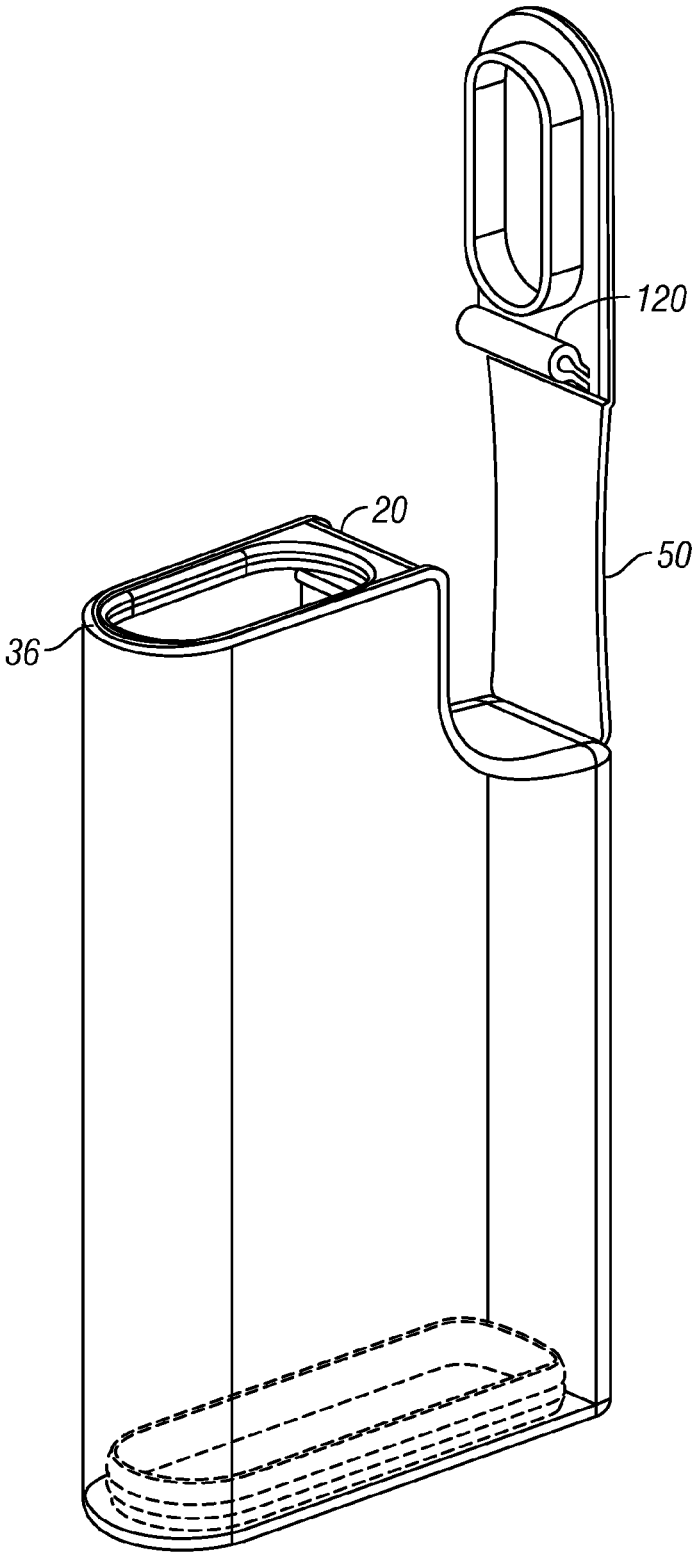
FIG. 7 is a view of a dispensable product container illustrating a tab to attach the flexible member to the top face segment.

FIG. 7 illustrates a container which uses a protrusion 120 connected to flexible member to insert into a receptacle at the top face edge 20 to connect the press portion 50 with the top face segment 36. When engaged into the body receptacle, the protrusion acts as a pivot or axis of rotation when force is applied to the press portion, which lifts the lid.

Figure 8:
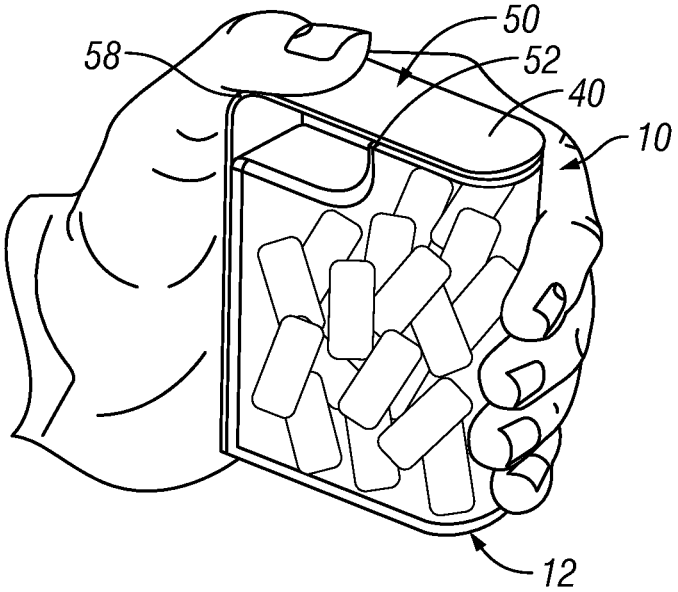
FIG. 8 is an illustration of a user holding a closed product container.
Figure 9:
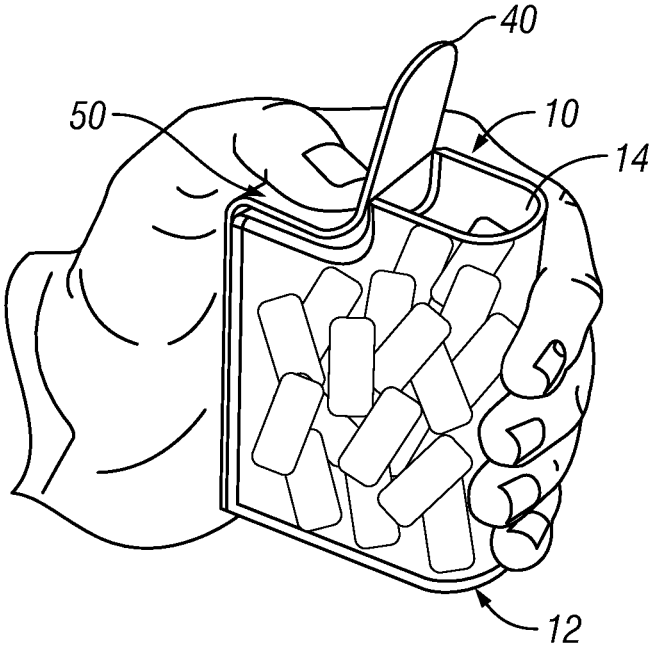
FIG. 9 is an illustration of a user engaging a press portion and opening the product container.
Figure 10:
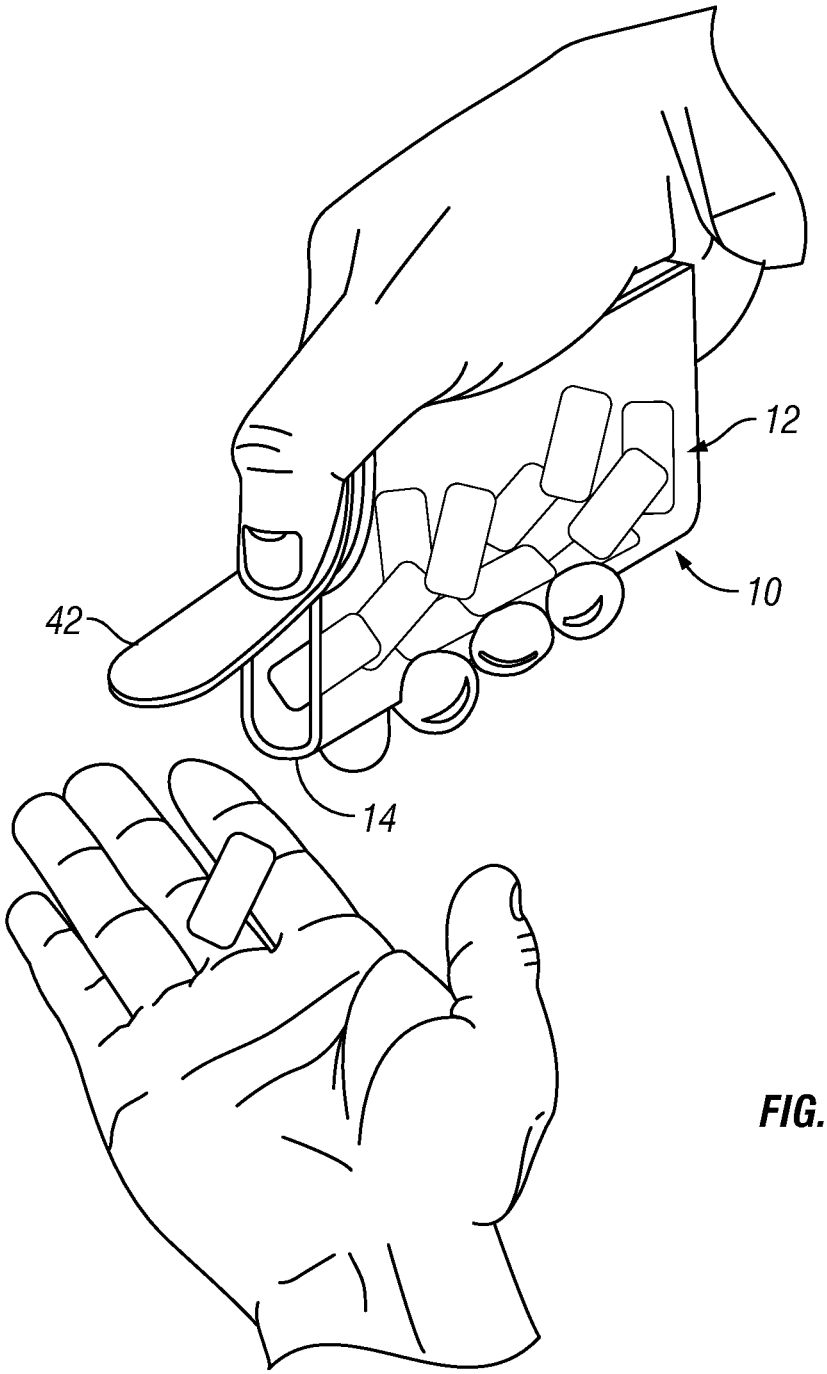
FIG. 10 is an illustration of a user dispensing pellet style chewing gum from the product container.

FIGS. 8, 9, and 10 illustrate a consumer applying force to a middle region 58 of a press portion 50 to rotate lid from opening 14 and removing product from the container.

Figure 11:
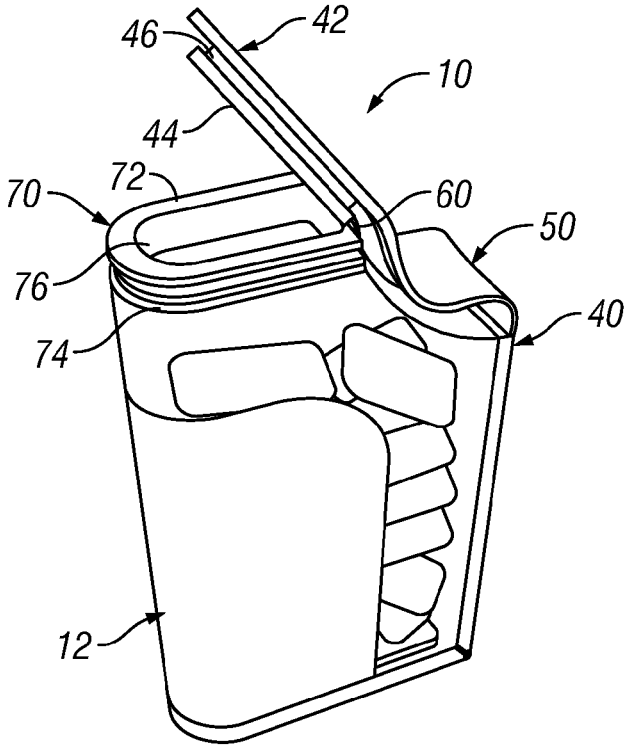
FIG. 11 is a picture of the product container with the press depressed and the lid in an open position.

As further illustrated in FIG. 11, press portion 50 may remain in the downward position with the lid open after a user's thumb is removed. To close lid 42, the user may pull up the press 50, manually move the lid 42 down or permit the press 50 to spring back to its normal stationary convex position.

Further as seen in FIG. 11, the flexible member 40 also may include an insert 70 which fits inside the top opening 14 of the receptacle 12 such that lid 42 fits into insert rather than directly into top opening 14. Insert 70 is attached to the wrap 40 at hinge 60 and has an outer edge 72 corresponding to the top opening 14 of the receptacle 12 and a gasket insert 74 which fits within an upper channel 34 of the receptacle 12. Insert 70 also may have an indent portion 76 to receive catch 46 of lid insert 44. Catch 46 is designed to engage the indent portion 76.

Figure 12:
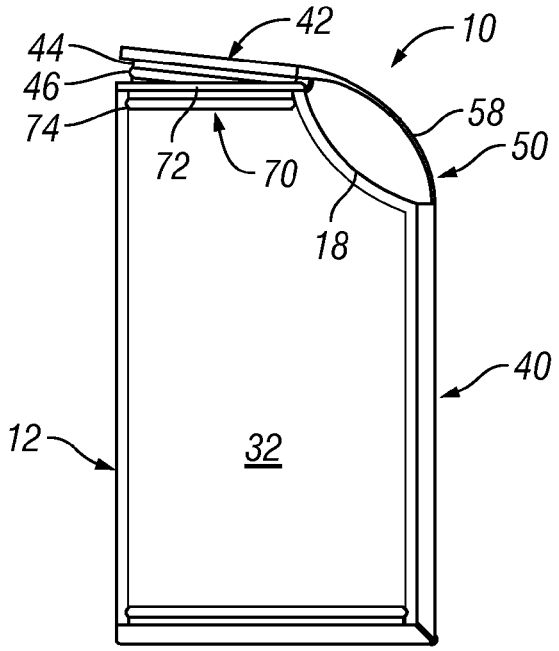
FIG. 12 is a side view of the comestible container with the lid closed but with the lid catch not in engagement with an indent portion of an opening insert.

As further seen in FIG. 12, press portion 50 may not exert enough downward force independently to return catch 46 into indent 76. However, press portion 50 exerts enough pressure to maintain the lid closed against the force of any upturned product such as a confectionery if the product container 10 is held in an upside-down position until the user manually presses the catch 46 into indent portion 76. As such, the lid will prevent product from escaping from container 12, even if accidentally opened.

These illustrations of embodiments of the present invention are not intended to limit the scope of such invention. Changes and modifications may be made without departing from the spirit and scope of the present invention without diminishing the invention's intended advantages.

What is claimed is:

1. A container comprising:

a) a body comprising a top, a bottom face, a front face, a back face, and at least one side face, in which the top has at least two face segments comprising
   i. a first top face segment having an opening to the container, and
   ii. a second downwardly sloping concave top face segment connected to the first top face segment and a side face; and b) a separate continuous flexible member connected to the side face, the member having
   i. a lid portion which covers the container opening,
   ii. a flexible press portion extending from the lid portion to the side face over the second top face segment, and normally convex to the second top face segment, and
   iii. a side portion extending from the flexible press portion and substantially covering the entire side face, wherein application of a downward force to the convex flexible press portion is capable of transforming the convex portion to concave, which rotates the lid portion to uncover the opening.

2. The container of claim 1 in which a top opening insert is hinged to the flexible member and adapted to engage the lid portion.

3. The container of claim 1 in which the first top face segment is parallel to the bottom face.

4. The container of claim 1 in which the flexible member is connected to the side face adhesively, mechanically, or by overmolding.

5. The container of claim 1 which has a bottom body opening and a bottom opening cover.

6. The container of claim 1 in which the flexible member further comprises a hinged bottom cover portion adapted to fit within a bottom body opening.

7. The container of claim 5 in which the bottom opening cover is fused shut.

8. The container of claim 1 in which the body is formed from a rigid plastic.

9. The container of claim 1 in which the flexible member is formed from a polyolefin thermoplastic elastomer.

10. The container of claim 1 adapted to dispense product pieces.

11. The container of claim 1 adapted to dispense comestibles.

12. The container of claim 11 in which the comestibles comprise chewing gum.

13. The container of claim 11 which contains 15 to 60 product pieces.

14. The container of claim 1 in which a side face is curved and forms a spout portion.

15. A container comprising:

a) a body comprising a top, a bottom face, a front face, a back face, and at least one side face, in which the top has at least two face segments comprising i. a first top face segment having an opening to the container, and ii. a second downwardly sloping concave top face segment connected to the first top face segment and a side face; and b) a separate continuous flexible member connected to the side face, the member having i. a lid portion which covers the container opening, and ii. a flexible press portion extending from the lid portion to the side face over the second top face segment, and normally convex to the second top face segment, wherein application of a downward force to the convex flexible press portion is capable of transforming the convex portion to concave, which rotates the lid portion to uncover the opening, and wherein a top opening insert is hinged to the flexible member and adapted to engage the lid portion.

16. A container comprising:

a) a body comprising a top, a bottom face, a front face, a back face, and at least one side face, in which the top has at least two face segments comprising i. a first top face segment having an opening to the container, and ii. a second downwardly sloping concave top face segment connected to the first top face segment and a side face; and b) a separate continuous flexible member connected to the side face, the member having i. a lid portion which covers the container opening, ii. a flexible press portion extending from the lid portion to the side face over the second top face segment, and normally convex to the second top face segment, and iii. a hinged bottom cover portion adapted to fit within a bottom body opening, wherein application of a downward force to the convex flexible press portion is capable of transforming the convex portion to concave, which rotates the lid portion to uncover the opening.

* * * * *